US008967430B2

(12) United States Patent
Wrigley

(10) Patent No.: US 8,967,430 B2
(45) Date of Patent: Mar. 3, 2015

(54) TAP ASSEMBLY

(75) Inventor: Andrew Nicholson Wrigley, Auckland (NZ)

(73) Assignee: Illinois Tool Works, Inc., Glenview, IL (US)

( * ) Notice: Subject to any disclaimer, the term of this patent is extended or adjusted under 35 U.S.C. 154(b) by 107 days.

(21) Appl. No.: 13/638,687

(22) PCT Filed: Apr. 15, 2011

(86) PCT No.: PCT/NZ2011/000053

§ 371 (c)(1),
(2), (4) Date: Oct. 1, 2012

(87) PCT Pub. No.: WO2011/133049

PCT Pub. Date: Oct. 27, 2011

(65) Prior Publication Data

US 2013/0015202 A1 Jan. 17, 2013

(30) Foreign Application Priority Data

Apr. 19, 2010 (NZ) ..... 584742

(51) Int. Cl.

| | |
|---|---|
| ***B67D 1/00*** | (2006.01) |
| ***B65D 35/56*** | (2006.01) |
| ***B65D 35/28*** | (2006.01) |
| ***B67D 3/00*** | (2006.01) |
| ***B67D 3/04*** | (2006.01) |

(52) U.S. Cl.
CPC ..... *B67D 3/045* (2013.01)
USPC ..... 222/83; 222/105; 222/514

(58) Field of Classification Search
USPC ..... 222/105, 107, 92, 95, 207, 212, 209, 222/185.1, 215, 214, 511, 513, 514, 80–91; 137/68.3
See application file for complete search history.

(56) References Cited

U.S. PATENT DOCUMENTS

| | | | |
|---|---|---|---|
| 4,322,018 | A | 3/1982 | Rutter |
| 4,416,395 | A | 11/1983 | Gaubert |
| 4,440,316 | A | 4/1984 | Christine |

(Continued)

FOREIGN PATENT DOCUMENTS

| | | | |
|---|---|---|---|
| GB | 2156949 | A | 10/1985 |

OTHER PUBLICATIONS

An International Search Report and Written Opinion, dated Jul. 18, 2011, in International Application No. PCT/NZ2011/000053.

*Primary Examiner* — Kevin P Shaver
*Assistant Examiner* — Stephanie E Williams
(74) *Attorney, Agent, or Firm* — Lowe Hauptman & Ham LLC

(57) ABSTRACT

The present invention relates to a tap assembly for dispensing fluids from a flexible film bag such as a "bag-in-box". Known taps associated with such flexible bags do not efficiently dispense fluid from a bag which is partially collapsed and/or can damage the opposite wall of the partially collapsed bag. The tap assembly includes a body with a bore, an actuation member to cover at least a portion of the bore and a piercer which is configured to pivot within the bore and pierce and cut a sterility membrane positioned over an open end of the bore upon movement of the actuation member by a user. The piercer comprises a curved surface which functions to position the piercer away from the plane of the adjacent bag wall after initial piercing.

33 Claims, 8 Drawing Sheets
(8 of 8 Drawing Sheet(s) Filed in Color)

(56) References Cited

U.S. PATENT DOCUMENTS

| | | | | | |
|---|---|---|---|---|---|
| 4,475,670 | A | * | 10/1984 | Rutter | 222/83 |
| 4,624,392 | A | * | 11/1986 | Malpas et al. | 222/83 |
| 4,684,038 | A | | 8/1987 | Gaul et al. | |
| 4,881,662 | A | * | 11/1989 | Tallman | 222/81 |
| 5,292,021 | A | * | 3/1994 | Lyon | 220/253 |
| 5,379,918 | A | | 1/1995 | Goto | |
| 6,446,845 | B1 | * | 9/2002 | Steiger | 222/509 |
| 6,648,186 | B2 | * | 11/2003 | Roethel et al. | 222/509 |

* cited by examiner

TAP ASSEMBLY

RELATED APPLICATIONS

The present application is based on International Application No. PCT/NZ2011/000053, filed Apr. 15, 2011 and claims priority from, New Zealand Application Number 584742, filed Apr. 19, 2010.

STATEMENT OF CORRESPONDING APPLICATIONS

This application is based on the Provisional specification filed in relation to New Zealand Patent Application Number 584742, the entire contents of which are incorporated herein by reference.

TECHNICAL FIELD

The present invention generally relates to a tap assembly. In particular, a tap assembly for dispensing a fluid stored within a flexible film bag.

BACKGROUND ART

The use of taps to dispense fluids from a collapsible bladder or bag such as those housed within a box (known as "bag-in-box") or other rigid containers is known. In the case of the "bag-in-box" arrangement, the tap is fluidly connected to the bag and extends through an opening in the box so that a user can dispense the fluid in the bag via the tap without opening the box. Such bags are formed by form-fill-and-seal (FFS) processes.

A disadvantage with such taps is that the tap does not always efficiently dispense fluid from a bag which has been partially emptied of fluid, due to collapse of the bag on itself resulting in the cut-off of fluid flow to the tap.

The use of a combined piercer and valve is known (such as that disclosed in U.S. Pat. No. 4,440,316). The piercer functions to puncture the bag wall to which the base of the tap is attached when the tap is actuated (usually by depressing a button cap). In this way sterility of the fluid in the bag is maintained during transportation and storage before first use of the tap.

A disadvantage with such bag and tap combinations is that the piercer can also puncture the opposite wall of the bag, particularly when the bag has been partially emptied. In addition, the wall flap cut by the piercer can later occlude the fluid pathway to the tap thereby restricting fluid flow from the tap.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

According to one aspect of the present invention there is provided a tap assembly for dispensing a fluid from a fluid container, the tap assembly comprising:

- a body having a bore formed therein;
- an actuation member configured to move axially within the bore and cover at least a portion of the bore; and
- a piercer configured to pierce and cut an adjacent sterility film as a result of movement of the actuation member by a user wherein the piercer is pivotable with respect to the bore and comprises a substantially curved surface configured to form a barrier to prevent blockage of the fluid within the bore from the cut sterility film and position the piercer away from an adjacent wall of the fluid container after piercing and cutting of the sterility film.

Preferably, the fluid container is a flexible film bag to which the body of the tap assembly is attached.

Preferably, the bore is configured to facilitate fluid communication between an open end of the body configured for attachment to a fluid container and an exit spout.

Preferably, the actuation member is configured to move the piercer from a retracted position, whereby the piercer is housed within the bore of the tap, to an extended position, whereby a substantial portion of the piercer extends from the bore of the tap.

More preferably, the piercer is moved from the retracted position to the extended position via the curved surface of the piercer abutting an end surface of the actuation member as the actuation member is moved axially within the bore.

Preferably, the piercer is attached to the body at at least one pivot point.

More preferably, the piercer is attached to the body at two pivot points.

More preferably still, the pivot points are joined by a shaft. In this way the piercer is strengthened against breakage during movement of piercer.

Preferably, the piercer is held temporarily within the within the bore before first use of the tap assembly via a protrusion on the curved surface of the piercer, wherein the protrusion is configured to retained in a corresponding detent on a wall surface of the bore.

Preferably, the substantially curved surface comprises at least one cutting edge.

More preferably, the at least one cutting edge comprises at least one serration configured to maintain the piercer in place relative to the sterility film after entry of the piercer into the sterility film and subsequent cutting by the cutting edge. In this way, the piercer first pierces an initial point of entry into the sterility film to minimise the piercing force required and then cuts an opening in the sterility film with the cutting edge after actuation of the piercer by the actuation member.

Preferably, the piercer also comprises at least one fluid passageway to facilitate the flow of fluid between the fluid container and the tap assembly after piercing and cutting of the sterility film by the at least one cutting edge.

Preferably, the substantially curved surface is configured to pull away the cut sterility film from the intended fluid flow path after piercing and cutting of the sterility film.

Preferably, a second sterility film is attached over the bore on an end of the exit spout and configured for removal before first use of the tap assembly.

Preferably, the tap assembly also includes a cap configured to cover an end of the actuation member and attach to the body to prevent inadvertent activation of the tap assembly before first use.

More preferably, the cap comprises a weakened join configured to tear and release the cap from the actuation member.

BRIEF DESCRIPTION OF DRAWINGS

The patent or application file contains at least one drawing executed in color. Copies of this patent or patent application publication with color drawings will be provided by the Office upon request and payment of the necessary fee.

Further aspects of the present invention will become apparent from the following description which is given by way of example only and with reference to the accompanying figures in which.

BEST MODES FOR CARRYING OUT THE INVENTION

Figure 1:
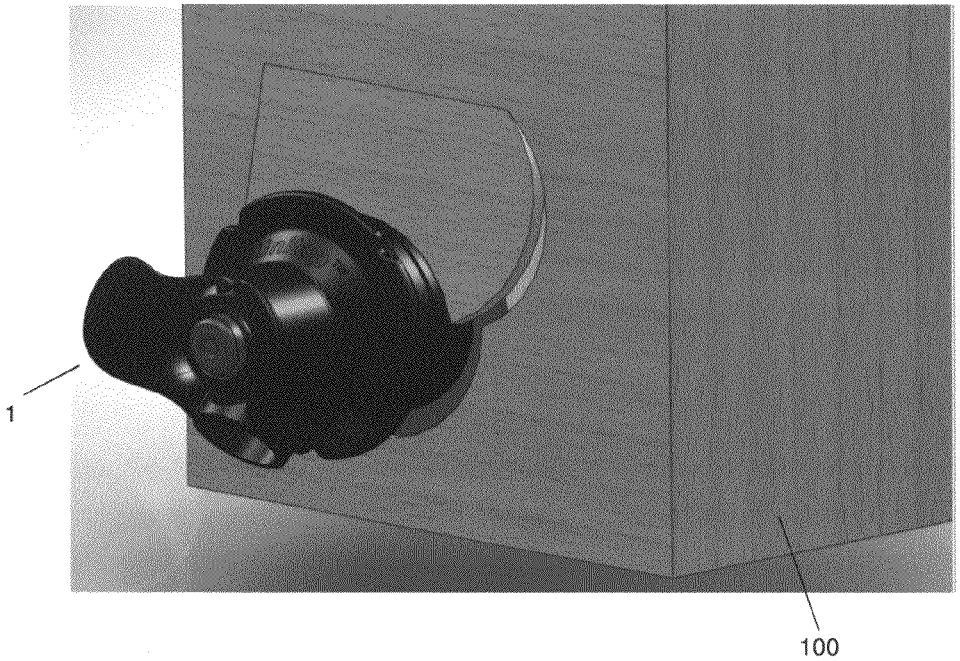
FIG. 1 shows a perspective view of a preferred embodiment of the present invention in the form of a tap assembly.
Figure 2:
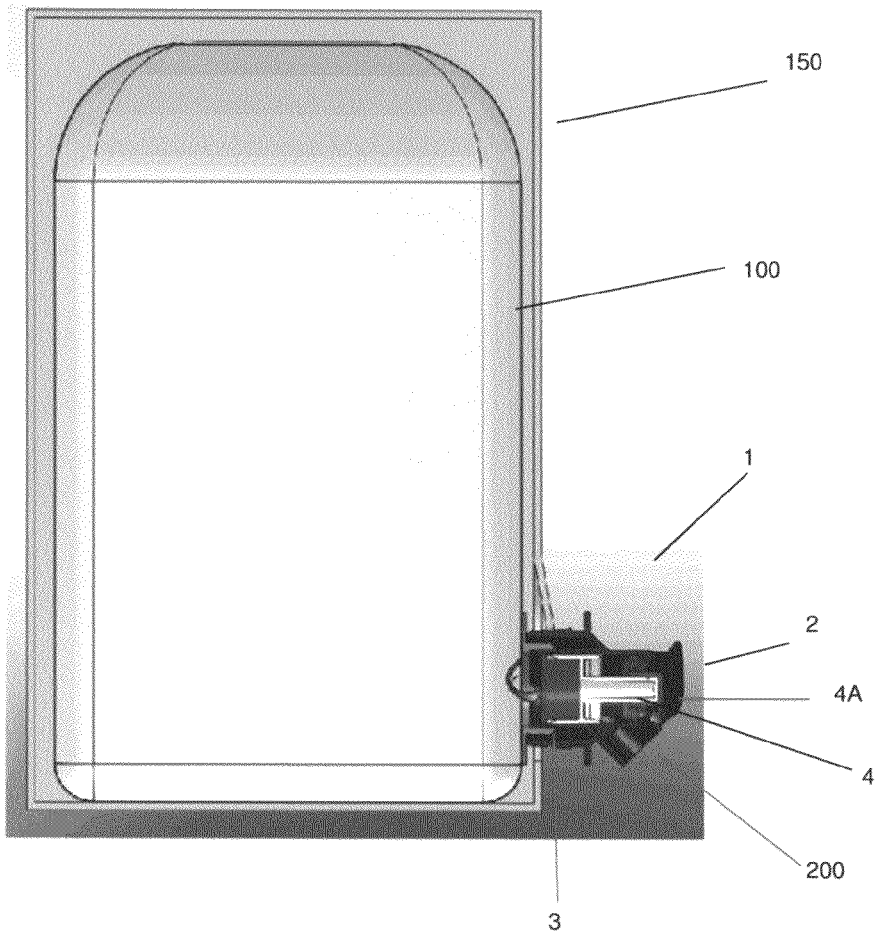
FIG. 2 shows a side section view of the preferred embodiment shown in FIG. 1 attached to a "bag-in-box" packaging container.

A preferred form of the invention in the form of a tap assembly generally indicated by arrow 1 attached to a fluid container in the form of a "bag-in-box" (BIB) including a flexible film bag 100 (as shown in FIG. 2) to store liquids such as wine. The BIB also includes a rigid container in the form of a cardboard box 150 (best seen in FIG. 1).

The tap assembly 1 includes a body 2 having a bore 3 formed therein for fluids to flow through the tap assembly 1 from an open end 2A adjacent the fluid bag 100 to exit the body 2 at spout 200. Typically the body 2 is formed in a plastics material by injection moulding. The tap assembly 1 also includes an actuation member 4 in the form of a push-rod which is configured to move axially within the bore 3 and cover a portion of the bore 3, and a button 4A on the end of the push rod 4 to control movement of the push rod 4 and thereby flow of fluid through the spout 200.

Figure 3:
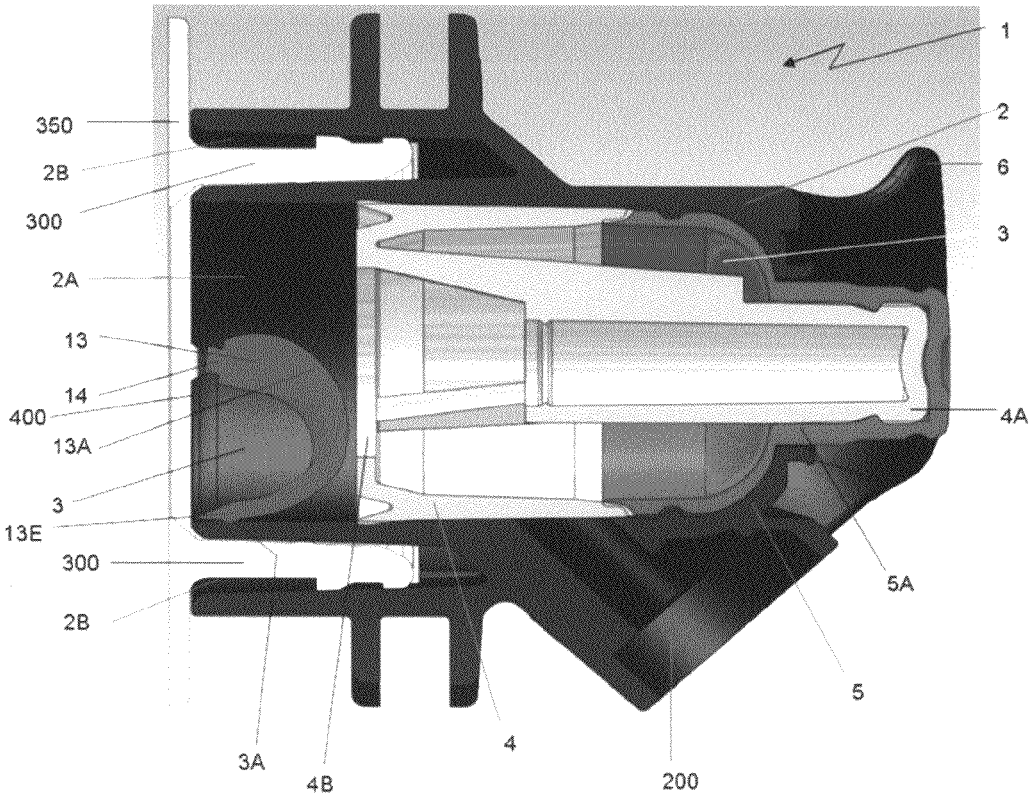
FIG. 3 shows a side section view of the embodiment shown in FIG. 1 in a closed position.
Figure 5:
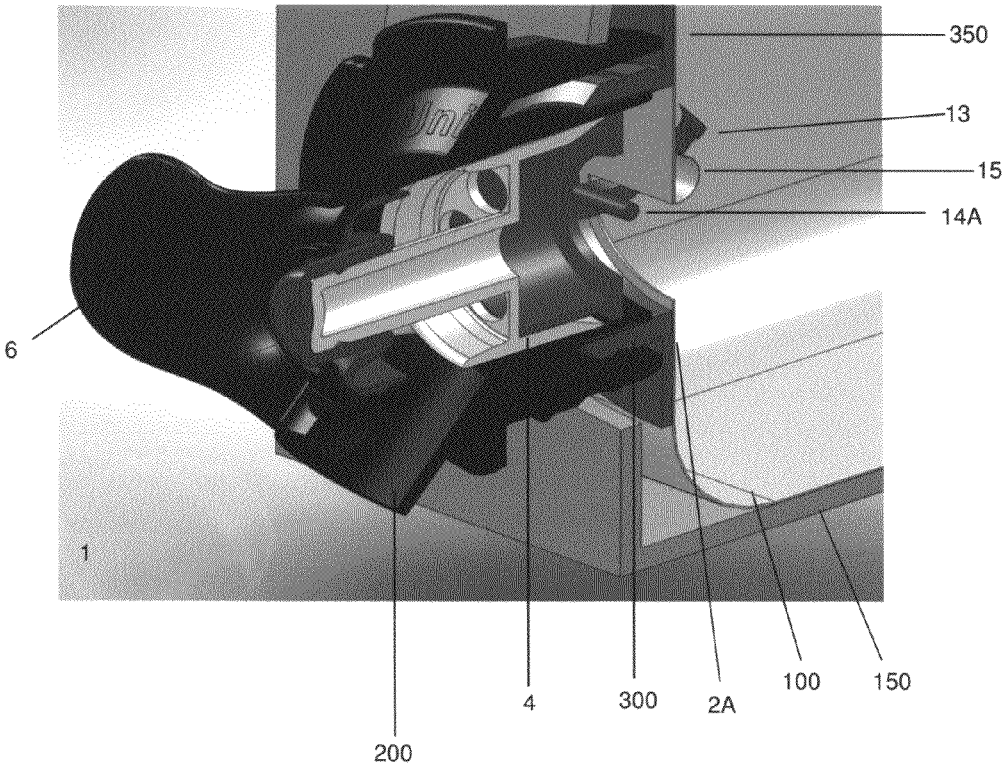
FIG. 5 shows a perspective section view of the embodiment shown in FIG. 4 in an opened position.

The body 2 is fixed to the bag 100 at a pair of latches 300 which extend into and attach to the body 2 at slots 2B. The latches 300 extend from a plate 350 which is fixed to the external wall of the bag 100 (as shown in FIGS. 3 and 5). The actuation member 4 is connected to the body 2 by first 5 and second 5A seals. In this way aseptic conditions are maintained inside the tap assembly 1 during actuation of the button 4A.

Wing-like projections 6 extends from the body 2 near the button 4A to provide convenient surfaces, transverse to the body, for an operator to grip with their index and middle fingers while depressing the button 4A with their thumb.

Figure 4:
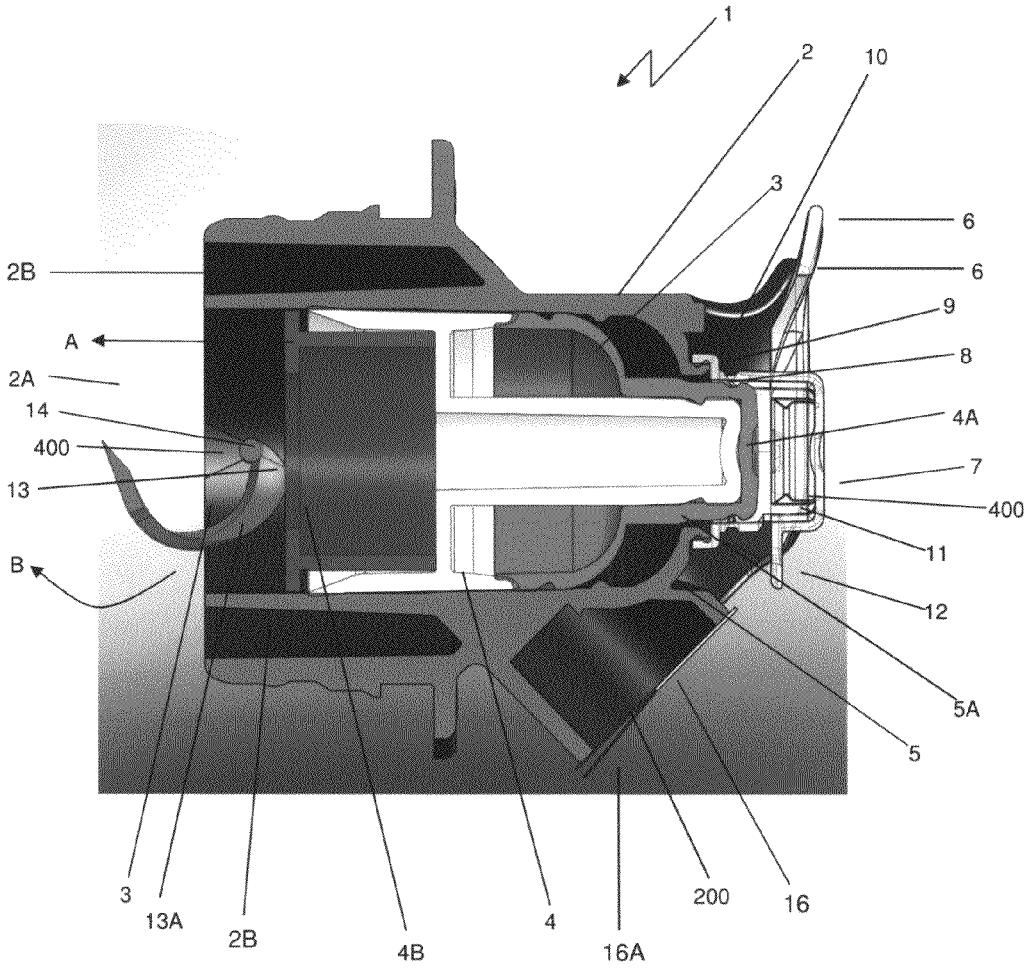
FIG. 4 shows a side section view of another preferred embodiment of the present invention in an opened position.

The tap assembly 1 optionally includes a cover in the form of a cap 7 (as shown in FIG. 4) which encloses and abuts the button 4A to prevent actuation of the button 4A before first use of the tap assembly 1. Cap 7 is fitted by clip-fit engagement with annular lip 8 on body 2. The cap 7 attaches to lip 8 of the body 2 at a sealing groove 9 which aseptically seals the cap 7 over the button 4A to the body 2 via a seal surface 10. In this way, actuation of the button 4A is prevented by an internal pressure differential, such as a vacuum within the tap assembly 1. In addition the cap 7 connects to the periphery of the button 4A by clip-fit engagement of annular bead 11 of cap 7 with retainer groove 500 which retains the seal 5A with respect to the cap 7. The cap 7 has a pull tab 12 to facilitate a user gripping the cap 7 for removal.

Figure 7:
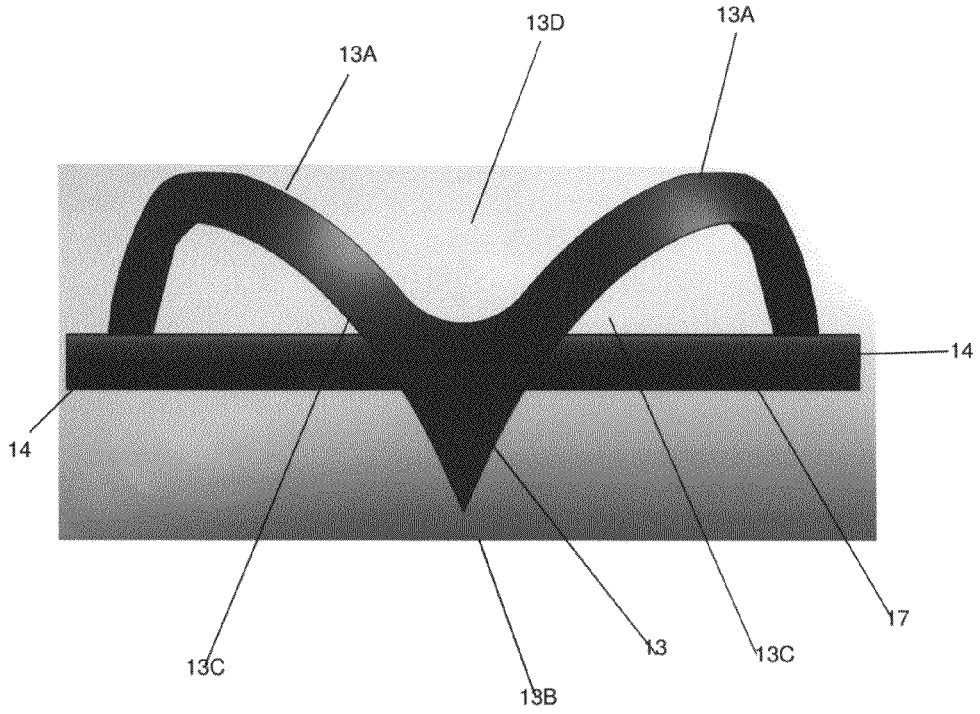
FIG. 7 shows a schematic side view of the piercer of the embodiment shown in FIG. 4.
Figure 8:
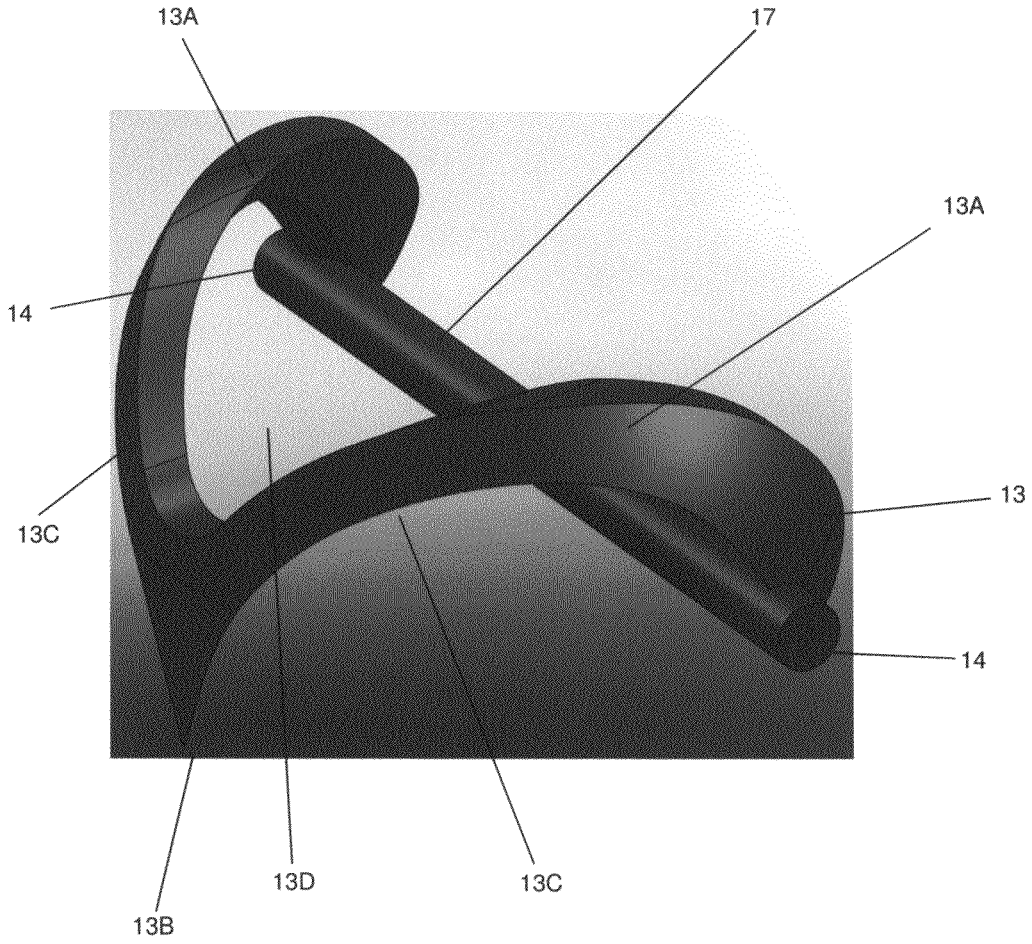
FIG. 8 shows a schematic perspective view of the piercer shown in FIG. 7.

The tap assembly 1 also includes a piercer 13 attached to the body 2 via pivot bar 14 (best seen in FIGS. 7 and 8) at a socket cup 400 at opposing positions on the wall of the bore 3 and proximal to the open end 2A of the body 2. The pivot points 14 are joined by a shaft 14A (shown in FIG. 5) which strengthens the pivot points 14 against breakage during movement of the piercer 13. The piercer 13 comprises a substantially curved surface in the form of a first curved surface 13A (best seen in FIGS. 7 and 8) which abuts an end wall 4B of push-rod 4. The end wall 4B moves over the first curved surface 13A in a cam action in a short actuation stroke to translate to rotation of the piercer 13 about pivot bar 14.

The tap assembly 1 includes a pierce-able sterility film 15 (best seen in FIGS. 5 and 6) attached over the open end 2A of the body 2. The sterility film 15 may be made of any suitable material which provides a barrier to the exchange of fluids between a fluid container (not shown) and the bore 3. The sterility film 15 improves the quality of oxygen sensitive fluids such as wine to improve the shelf life of the fluid during transport and storage and before use of the fluid container and is attached to the end of the bore 3 by any suitable process known to those skilled in the art, such as heat sealing. Such a sterility film 15 can also provide a further barrier to contamination of the fluid by micro organisms before first use of the tap assembly 1.

A further sterility film 16 is optionally provided over the end of the spout 200 (as shown in FIG. 4) to provide a further barrier to fluid exchange and/or micro organism contamination before first use. The sterility film 16 is provided with a flap 16A for easy removal as is known in the art.

The piercer 13 comprises a piercing point 13B which provides an initial point of entry into an adjacent film surface 15, as the piercer 13 rotates, and which minimises the force required to pierce the sterility film 15 by the push-rod 4. Cutting edges along both sides of the second curved surface 13C cuts a flap 500 (best seen in FIGS. 5 and 6) in the film surface 15 as the piercer 13 moves to its extended position. Once the sterility film 15 has been pierced and cut there is resultant flow of fluid from the attached fluid container (not shown). The configuration of second curved surface 13C forms an aperture 13D which provides a fluid entry port for fluid flow after the projections 16 have pierced the sterility film 15. In addition, the shape of the second curved surface 13C is configured to pull away the cut sterility film 15 from the intended fluid flow path in the bore 3. The pivot points 14 are connected by a shaft 17 to strengthen against breakage during operation. The configuration of the surface of the end wall 4B and first curved surface 13A provides sufficient force to pierce and cut the adjacent film 15 and provide a clear passage way for fluid flow.

After movement of the piercer 13 to its extended position, the first curved surface13A acts as a barrier to prevent blockage of the opened fluid path by the cut flap 500 of the sterility film 15 which is retained against first curved surface 13A on which the cutting edges are positioned. The first curved surface 13A also acts as a barrier to a further film surface such as an opposite film wall of a fluid bag, which may block the fluid path during partial evacuation of the bag. In addition, the first curved surface 13A of the piercer 13 acts to displace the piercing point 13B and cutting edges away from the plane of an opposite film wall of a fluid bag to prevent puncture of the opposite wall during the initial piercing process and consequent leakage of fluid from the fluid bag.

During transport of the tap assembly 1, associated container 150 and film bag 100 and prior to first use, the piercer 13 is held temporarily in position inside the bore 3 and away from the unpierced sterility film 15 via a ball protrusion 13E which clips into ball detent 3A positioned on the bore 3 wall surface (as shown in FIG. 3). This arrangement prevents contamination of the sterile fluid inside the bag 100 by the non-sterile piercer 13. The force of the cam action of the first curved surface 13A and the end wall 4B of the actuation member 4 is sufficient to detach the ball protrusion 13E of the piercer 13 from the ball detent 3A.

Figure 6:
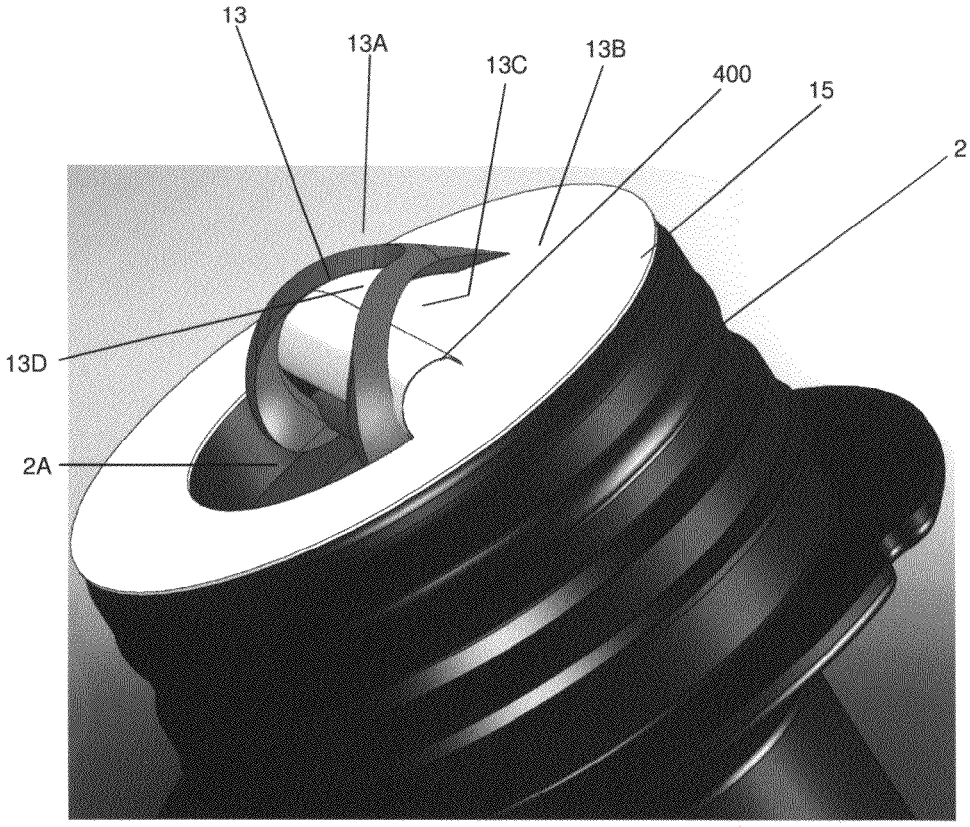
FIG. 6 shows a schematic perspective view of the embodiment shown in FIG. 4 with the piercer displaced through an adjacent sterility membrane.

In use, actuation of the push-rod 4 by a user via button 4A (in the direction of arrow A shown in FIG. 4) causes rotation of the piercer 13 on its axis by substantially 90° (defined by pivot points 14 and in the direction of arrow B shown in FIG. 4) via sliding contact of the first curved surface 13A with the push-rod 4. Thus, as push rod 4 is moved down the bore, piercer 13 moves from a retracted position, whereby the piercer 13 is housed within the bore 3 (as shown in FIG. 3), to an extended position, whereby a substantial portion of the piercer 13 extends from the bore 3 of the tap assembly 1 (as shown in FIGS. 4 to 6).

A person skilled in the art will appreciate that other methods of actuation of the piercer 13 to puncture and cut the membrane 15 may be used without departing from the scope of the present invention. For example, the body of the tap assembly 1 may be rotated 180° relative to the spout 200 by the user prior to first use. Rotation of the body 2 may actuate the piercer 13 from its retracted position to its extended position with respect to the body 2 via a cam profile on an internal surface of the body 2 (not shown) to rotate the piercer 13 about the pivot bar 14.

A person skilled in the art will appreciate that the shape of the piercer 13 may be varied without departing from the scope of the present invention. Each cutting edge may optionally include at least one serration (not shown) configured to maintain the cutting edges in place relative to the sterility film 15 which will aid in the cutting efficiency of the piercer 13.

Thus preferred embodiments of the present invention have a number of advantages over the prior art which include:

- improved efficiency of dispensing fluids from a film bag (150);
- improved sterility of a stored fluid before first use of the tap assembly (1); and
- improved security from damaging a connected a film bag (150).

Where, in the foregoing description, reference has been made to integers or components then such equivalents are incorporated herein.

Aspects of the present invention have been described by way of example only and it should be appreciated that modifications and additions may be made thereto without departing from the scope thereof as defined in the appended claims.

What we claim is:

1. A tap assembly for dispensing a fluid from a fluid container, the tap assembly comprising:

a body having a bore formed therein;

an actuation member configured to move axially within the bore and cover at least a portion of the bore; and a piercer configured to pierce and cut an adjacent sterility film as a result of movement of the actuation member by a user wherein the piercer is pivotable with respect to the bore and comprises a substantially curved surface configured to form a barrier to prevent blockage of the fluid within the bore from the cut sterility film and position the piercer away from an adjacent wall of the fluid container after piercing and cutting of the sterility film.

2. The tap assembly as claimed in claim 1 wherein the fluid container is a flexible film bag to which the body of the tap assembly is attached.

3. The tap assembly as claimed in claim 1 wherein the bore is configured to facilitate fluid communication between an open end of the body configured for attachment to a fluid container and an exit spout.

4. The tap assembly as claimed in claim 1 wherein the actuation member is configured to move the piercer from a retracted position, whereby the piercer is housed within the bore of the tap, to an extended position, whereby a substantial portion of the piercer extends from the bore of the tap.

5. The tap assembly as claimed in claim 1 wherein the piercer is moved from the retracted position to the extended position via a curved surface of the piercer abutting an end surface of the actuation member as the actuation member is moved axially within the bore.

6. The tap assembly as claimed in claim 1 wherein the piercer is attached to the body at least one pivot point.

7. The tap assembly as claimed in claim 6 wherein the piercer is attached to the body at two pivot points.

8. The tap assembly as claimed in claim 7 wherein the pivot points are joined by a shaft.

9. The tap assembly as claimed in claim 1 wherein the piercer is held temporarily within the bore before first use of the tap assembly via a protrusion on the curved surface of the piercer, wherein the protrusion is configured to be retained in a corresponding detent on a wall surface of the bore.

10. The tap assembly as claimed in claim 1 wherein the piercer comprises at least one cutting edge.

11. The tap assembly as claimed in claim 10 wherein the at least one cutting edge comprises at least one serration configured to maintain the piercer in place relative to the sterility film after entry of the piercer into the sterility film and subsequent cutting by the cutting edge.

12. The tap assembly as claimed in claim 1, wherein the piercer also comprises at least one fluid passageway to facilitate the flow of fluid between the fluid container and the tap assembly after piercing and cutting of the sterility film by the at least one cutting edge.

13. The tap assembly as claimed in claim 1, wherein the piercer is configured to pull away the cut sterility film from the intended fluid flow path after piercing and cutting of the sterility film.

14. The tap assembly as claimed in claim 1, wherein a second sterility film is attached over the bore on an end of the exit spout and configured for removal before first use of the tap assembly.

15. The tap assembly as claimed in claim 1, wherein the tap assembly also includes a cap configured to cover an end of the actuation member and attach to the body to prevent inadvertent activation of the tap assembly before first use.

16. The tap assembly as claimed in claim 15 wherein the cap comprises a weakened join configured to tear and release the cap from the actuation member.

17. The tap assembly as claimed in claim 1, wherein the body includes a seal connecting the actuation member to the body, the seal being engageable with the cap.

18. The tap assembly as claimed in claim 1, wherein the body includes a wing-shaped projection peripherally extending from the body in the vicinity of the end of the actuation member.

19. The tap assembly as claimed in claim 1, wherein the body has an internal surface with a cam profile.

20. The tap as claimed in claim 9, wherein the protrusion of the piercer is configured to make an initial entry into the sterility film in response to a force applied to the end of the actuation member.

21. A tap assembly, comprising:

a tubular body having a through hole therein;

a spout connected to the tubular body and configured to discharge a fluid;

a shaft axially extending through the through hole in the tubular body, the shaft having a first end and a second end and configured to be slidably moved along the through hole in response to a force to be applied to the first end; and a claw-shaped cutter placed within the tubular body and having a leading end and a proximal end, the leading end facing an adjacent membrane to be disrupted by the cutter, the leading end being positioned between the membrane and the second end of the shaft, the cutter being pivotable with respect to the proximal end, wherein the shaft and the cutter are positioned in a substantially perpendicular relationship to each other to be operable in such a way that the sliding movement of the shaft is transmitted to the cutter from the second end of the shaft and is translated into a pivotal movement of the cutter to cause the leading end to advance into the membrane and secure a fluid passage way.

22. The tap assembly as claimed in claim 1, wherein the piercer is configured to pierce and cut an adjacent sterility film as a result of axial movement of the actuation member by a user.

23. The tap assembly as claimed in claim 1, wherein the actuation member is configured to move linearly within the bore.

24. The tap assembly as claimed in claim 1, wherein the piercer includes a point configured for piercing the film and sharp cutting edge configured to cut the pierced film after the tip has pierced the film.

25. The tap assembly as claimed in claim 1, wherein the piercer is configured to move relative to the actuation member.

26. The tap assembly as claimed in claim 1, wherein the tap assembly is configured such that the axial movement of the actuation member in a first trajectory results in rotational movement of the piercer in second trajectory different from the first trajectory.

27. The tap assembly as claimed in claim 26, wherein both the first and second trajectories lie in the same plane, and wherein the second trajectory diverges away from the first trajectory.

28. The tap assembly as claimed in claim 1, wherein the piercer is pivotable with respect to the actuation member.

29. The tap assembly as claimed in claim 1, wherein the piercer comprises two arms that extend towards each other to a single point, the point being configured to pierce, the arms having separate cutting edges, the cutting edges configured to cut.

30. The tap assembly as claimed in claim 1 wherein the actuation member is configured to move the piercer from a fully retracted position where the piercer has not pierced the film and where the piercer is housed within the bore of the tap, to a fully extended position where the piercer has pierced and cut the film, whereby a substantial portion of the piercer extends from the bore of the tap.

31. The tap assembly as claimed in claim 1 wherein the piercer is moved from the retracted position to the extended position via a camming action.

32. The tap assembly as claimed in claim 1 wherein the piercer comprises at least one cutting edge that extends in a curved manner away from a point of the piercer.

33. The tap assembly as claimed in claim 1, wherein the piercer is a curved "V" shaped component with space in between the arms of the "V."

* * * * *